US005921872A

United States Patent [19]

Kobayashi

[11] Patent Number: 5,921,872

[45] Date of Patent: Jul. 13, 1999

[54] GOLF CLUB

[75] Inventor: Kenji Kobayashi, Tsubame, Japan

[73] Assignee: K. K. Endo Seisakusho, Niigata-Ken, Japan

[21] Appl. No.: 09/136,989

[22] Filed: Aug. 20, 1998

Related U.S. Application Data

[30] Foreign Application Priority Data

Nov. 28, 1997 [JP] Japan ..... 9-327549

[51] Int. Cl.[6] ..... A63B 53/04

[52] U.S. Cl. ..... 473/345; 473/346; 473/350

[58] Field of Search ..... 473/345, 346, 473/349, 324, 327, 329, 342, 350; 273/167 H, 167 E, 167 J

[56] References Cited

U.S. PATENT DOCUMENTS 5,090,702 2/1992 Viste ..... 473/324
5,351,958 10/1994 Helmstetter ..... 473/324
5,601,501 2/1997 Kobayashi ..... 473/350
5,700,208 12/1997 Nelms ..... 473/324
5,704,850 1/1998 Shieh ..... 473/324

FOREIGN PATENT DOCUMENTS 9-38248 2/1997 Japan .

*Primary Examiner*—Kien T. Nguyen
*Attorney, Agent, or Firm*—Quarles & Brady LLP

[57] ABSTRACT

A golf club having a crown of such an improved strength that it can be thin-walled. A head 1 is hollow and metallic. A number of depressions 26 are formed by forging, for example, on nearly an entire area on an outside surface of a crown 1*a* of the head 1. Thus, the strength of the crown 1*a* is improved, thus enabling it to be thin-walled. Accordingly, the head 1 can be large-sized, with its center of gravity being lowered.

5 Claims, 4 Drawing Sheets

GOLF CLUB

BACKGROUND OF INVENTION

1. Field of Invention

The present invention relates to a golf club, particularly to the structure of its head.

2. Prior Art

Conventionally, as was disclosed in Japanese Patent Un-Examined Publication No. 9-38248, it is widely recognized to provide a golf club whose head is metallic and formed hollow. Such conventional head was constructed by for example joining a plurality of metallic shells together, said shells being formed by forging or the like.

In the past, such kind of conventional golf club had its upper surface or crown formed smooth, without any irregularities both on its outside surface and on its inside surface, though it was slightly curved. However, with such smooth crown, a relatively weak strength is resulted. A crown of a golf club does not require so great a strength as a ball-striking face thereof, but must be strong to a certain extent to withstand impacts developed in striking balls. Therefore, the material of the crown was formed thick to a certain extent in the past, which however would make it difficult to enlarge a head without increasing the weight of the head. With a large-sized head, even a beginner player can strike balls without failures, which advantage comes to nothing if the weight of the head is increased. Further, as a certain proportion of the whole weight has to be distributed to the crown, a degree of freedom in weight distribution relative to the whole head would be decreased. For example, whilst the center of gravity should be low in order to elongate the travelling distance of balls, the relatively heavy weight of the crown inevitably leads to the high center of gravity.

SUMMARY OF THE INVENTION

To eliminate the above problems, it is, therefore, an object of the invention to provide a golf club whose upper face portion or crown can be formed thin without degrading the strength of the crown.

To attain the above object, there is provided a golf club comprising: a hollow metallic head having a face on a front; a shaft connected to said head; and a plurality of depressions formed on an upper surface portion of said head, said upper surface portion including an outside surface and an inside surface, wherein said depressions are arranged on nearly an entire area on the upper surface portion of said head.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE INVENTION

Figure 1:
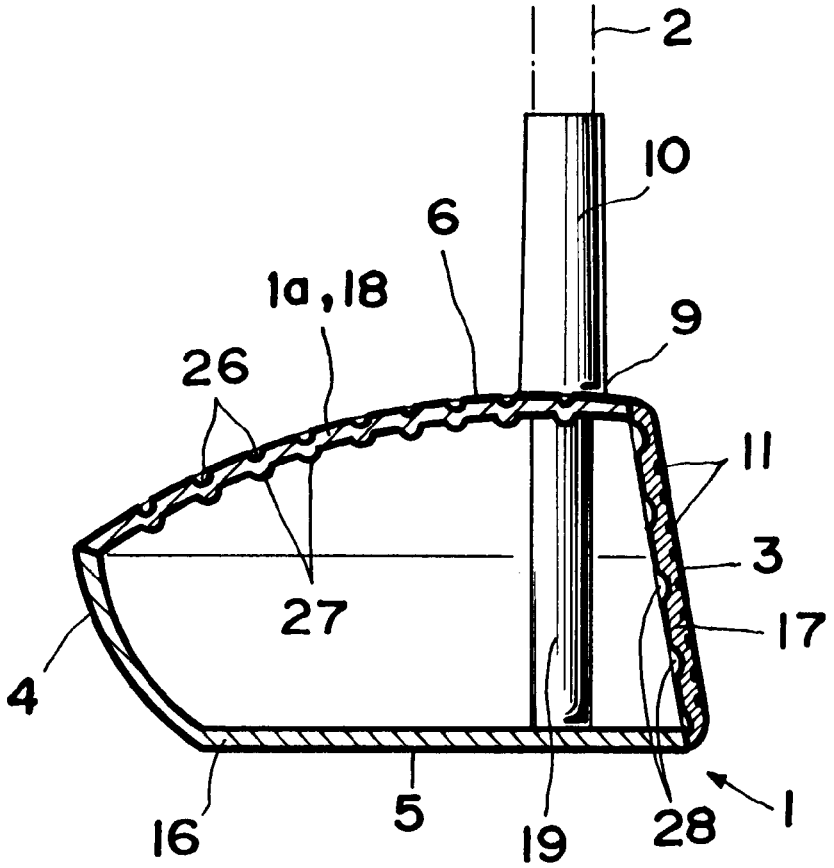
FIG. 1 is a section showing an embodiment of a golf club of the invention.
Figure 2:
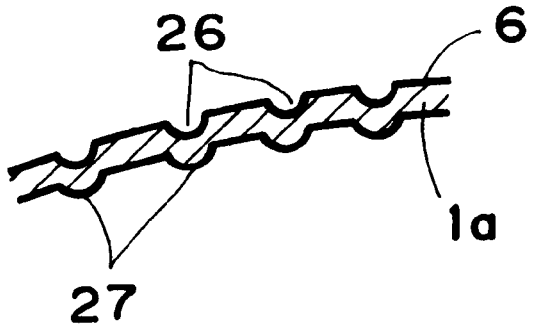
FIG. 2 is an enlarged section showing a crown of an embodiment of a golf club of the invention.
Figure 3:
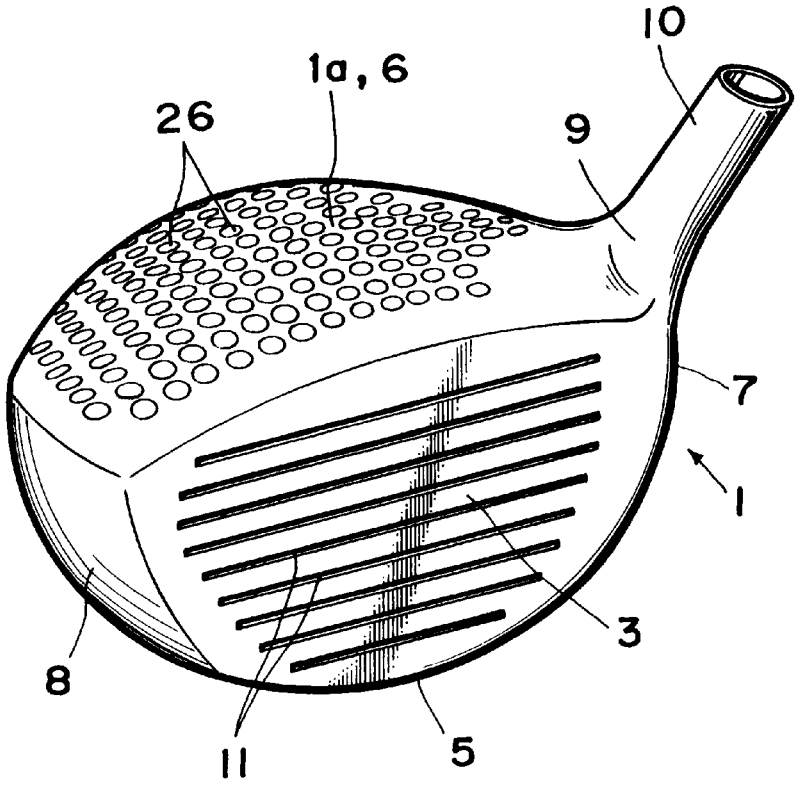
FIG. 3 is a perspective view showing an embodiment of a golf club of the invention.

Hereinafter is explained an embodiment of a golf club of the invention with reference to the attached drawings.

A golf club of the present embodiment is constructed by a hollow metallic head 1 and a shaft 2 connected to the head 1. The head 1 has a face 3 at its front side, a back 4 at its back side, a sole 5 at its lower side, a crown 6 at its upper side, a heel 7 at its proximal side and a toe 8 at its distal side, respectively. The heel 7 is formed at its upper side with a neck 9, from which extends upwardly a hosel 10. The hosel 10 serves as a shaft connector for connecting a shaft 2 thereto. Incidentally, a plurality of nearly horizontal concave grooves 11, which are called score lines, are formed on said face 3.

Figure 4:
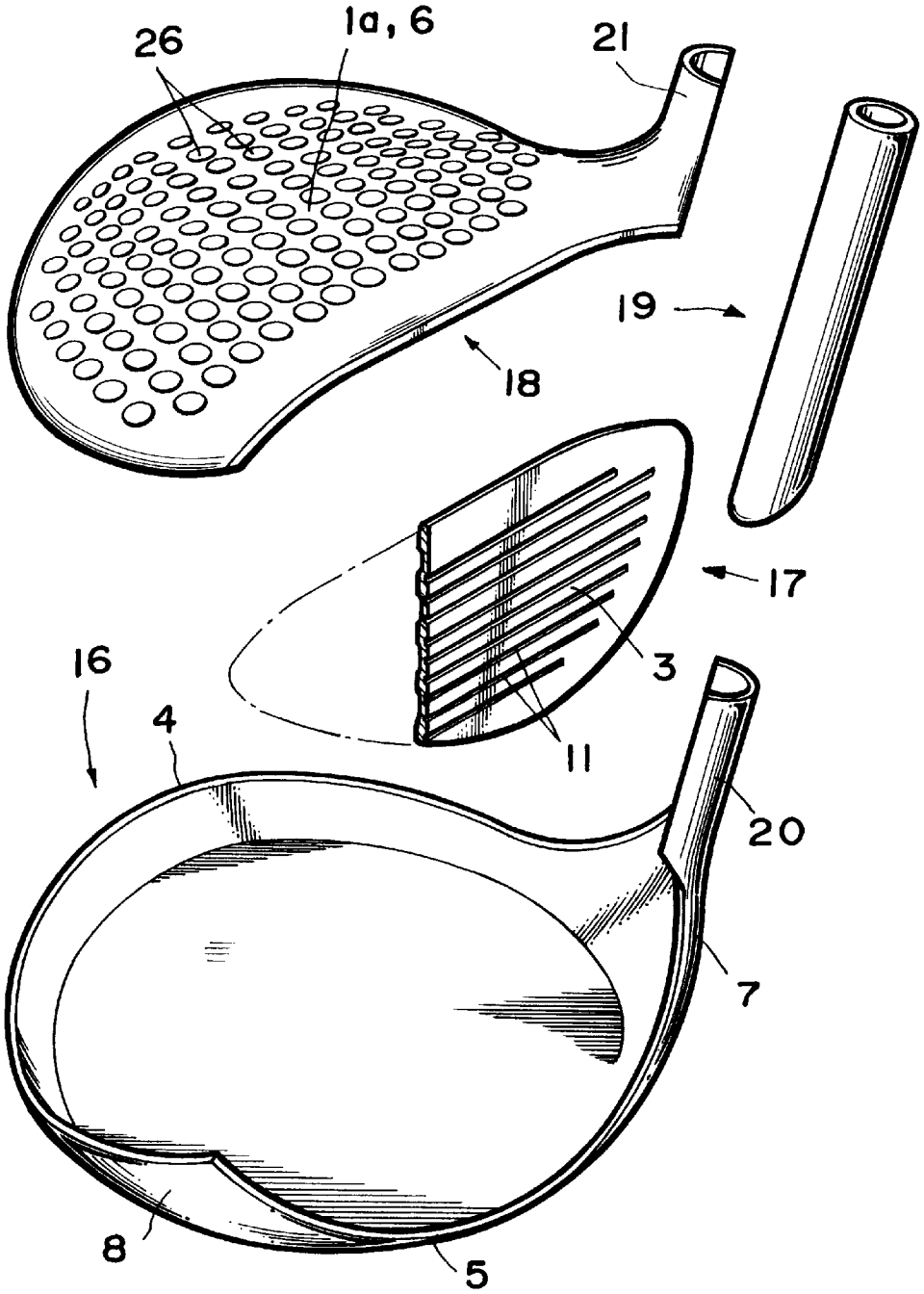
FIG. 4 is a partially cutaway, exploded perspective view showing an embodiment of a golf club of the invention.

The head 1 is constructed by for example joining a plurality of forged metallic shells together by welding or the like. Specifically as illustrated in FIG. 4, the head 1 in accordance with the present embodiment is constructed by a metallic shell or a body member 16, a face member 17, a crown member 18 and a mounting pipe 19. The body member 16 forms the back 4, sole 5, heel 7 and toe 8, while the face member 17 the face 3, the crown member 18 the crown 6, and the mounting pipe 19 the hosel 10, respectively.

The body member 16 is formed with one semi-cylindrical portion 20 which forms one side of the outer surface of the hosel 10, while the crown member 18 is formed with the other semi-cylindrical portion 21 which forms the other side of the outer surface thereof. In assembling the same, the edges of the body member 16, face member 17 and crown member 18 are welded to one another, while the lower end of the mounting pipe 19 is welded to the lower portion of the body member 16, and then, the respective semi-cylindrical portions 20 and 21 of the body member 16 and the crown member 18 are mounted so as to cover the upper portion of the mounting pipe 19 so that they are welded thereto. Alternatively, a hollow interior of the head 1 may be filled with urethane foamed material.

The outside surface of the upper surface portion or crown 1*a* of the head 1 is formed with a number of spherical depressions 26 arranged nearly along the entire surface thereof. These depressions 26 are formed at the time of forging the crown member 18, with the crown 1*a* having nearly the similar shapes in its outside surface and its inside surface, said inside surface being formed with expansions 27, corresponding to each depression 26. On the other hand, the face member 17 is formed on its outside surface with the aforesaid concave grooves 11, while on its inside surface with a number of depressions 28.

According to the structure of the embodiment, as a number of depressions 26 are formed on the outside surface of the crown 1*a* of the head 1, the strength of the crown 1*a* is improved, thus enabling the thickness of the crown 1*a* to be made thinner without sacrificing the strength of the crown 1*a*. The reason why the strength is improved by the formation of the depressions 26 is that even and fine tissues are resulted from the forming of the depressions 26 by forging, thus producing so-called grain flows, which leads to the enhanced stiffness and durability of the material. Further, as each depression is formed spherical, the grain flows are made unlikely to be disconnected, thus further improving the strength. Furthermore, even the dispersion of impacts can be expected as an effect of the uneven shape of the crown 1*a*.

In any case, since the crown 1*a* can be made thinner, the head 1 can be enlarged without increasing the weight of the head 1. With such enlarged head 1, so-called sweet area, i.e., an area on the face 3 where balls can travel comparatively straight and well when struck thereon, is widened, whereby there can be provided a golf club with which even a beginner player can strike balls without failures. Also, the weight thus decreased in the crown 1*a* is able to be distributed to the remaining portions of the head 1, thereby increasing a degree of freedom of the weight distribution of the whole head 1. For example, if the crown 1*a* is thus lightened and the lower portion of the head 1 is weighted, the center of gravity of the head 1 is made further lower, thus enabling the struck balls to be raised more easily, resulting in elongated travelling distances of balls. In addition, as the depressions 26 appear on the conspicuous crown 6, an original and distinguished design can be obtained thereby.

Moreover, the same effect is resulted by forming a number of depressions 28 on the inside surface of the face member 17. In other words, the face member 17 can be made thinner, without damaging the strength thereof. Accordingly, the head 1 can be enlarged without increasing the weight of the head 1, at the same time that a degree of freedom is increased in distributing the weight of the whole head 1.

Figure 5:
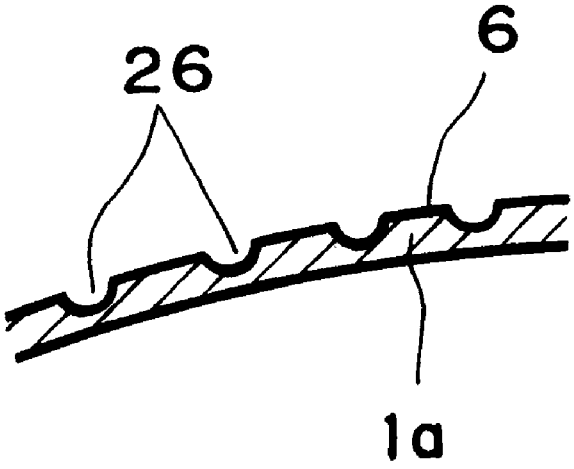
FIG. 5 is an enlarged section showing a crown of another embodiment of a golf club of the invention.

Incidentally, the present invention should not be limited to the foregoing embodiment, but may be modified within a scope of the invention. For example, although the foregoing embodiment proposes the structure such that the expansions 27 are provided on the inside surface of the crown 1*a* of the head 1, opposite to the depressions 26 on the outside surface thereof, the inside surface of the crown 1*a* may be formed smooth, without forming the expansions thereon, as illustrated in FIG. 5. On the contrary, the depressions may be only formed on the inside surface of the crown, while the outside surface of the crown may be formed even.

It should be noted that it is more advantageous if the outside surface of the crown is formed similar to the inside surface thereof, since the crown is able to be free from an extremely thin portion by forming this way, so that the head can be thin-walled as a whole.

Alternatively, the depressions may be formed on the inside surface of the crown, while the expansions on the outside surface thereof, corresponding to each depression. Further, the shapes, dimensions and arrangement of the depressions on the crown of the head should not be limited to those of the foregoing embodiment, but may be variously modified. The similar depressions may be formed on the back, sole, heel and/or toe of the head.

What is claimed:

1. A golf club comprising a hollow metallic head having a face on a front, a shaft connected to said head, and a plurality of depressions formed on an upper surface portion of said head, said upper surface portion including an outside surface and an inside surface;

wherein said depressions are arranged on nearly an entire area on the outside surface of the upper surface portion of said head; and wherein said golf club head further comprises:

a plurality of expansions on the inside surface of the upper surface portion of said head, corresponding to said depressions formed on the outside surface thereof, each of said expansions being formed into a shape similar to each depression and each of said expansions being formed in addition to the forming of said depressions.

2. A golf club according to claim 1, wherein said head is constructed by joining a plurality of metallic shells together, said metallic shells including a crown member which forms said upper surface portion, wherein said depressions and said expansions are formed on said crown member.

3. A golf club according to claim 1, wherein said depressions are formed by forging at the time of forging the upper surface portion of said head.

4. A golf club according to claim 1, further comprising a plurality of depressions formed on an inside surface of the face of said head.

5. A golf club comprising a hollow metallic head having a face on a front, a shaft connected to said head, and a plurality of depressions formed on an upper surface portion of said head, said upper surface portion including an outside surface and an inside surface.

wherein said depressions are arranged on nearly an entire area on the inside surface of the upper surface portion of said head; and wherein said golf club head further comprises;

a plurality of expansions on the outside surface of the upper surface portion of said head, corresponding to said depressions formed on the inside surface thereof, each of said expansions being formed into a shape similar to each depression and each of said expansions being formed in addition to the forming of said depressions.

* * * * *

UNITED STATES PATENT AND TRADEMARK OFFICE

CERTIFICATE OF CORRECTION

PATENT NO. : 5,921,872

DATED : July 13, 1999

INVENTOR(S) : Kobayashi

It is certified that error appears in the above-identified patent and that said Letters Patent is hereby corrected as shown below:

In Column 4, line 33 change "surface." to --surface,--

Signed and Sealed this

First Day of February, 2000

*Attest:*

*Attesting Officer*

Q. TODD DICKINSON

*Acting Commissioner of Patents and Trademarks*